US009903062B2

(12) United States Patent
Favaro et al.

(10) Patent No.: US 9,903,062 B2
(45) **Date of Patent: *Feb. 27, 2018**

(54) LAUNDRY WASHING MACHINE

(71) Applicant: Electrolux Home Products Corporation N.V., Brussels (BE)

(72) Inventors: Daniele Favaro, Porcia (IT); Maurizio Del Pos, Pordenone (IT)

(73) Assignee: Electrolux Home Products Corporation N.V., Brussels (BE)

( * ) Notice: Subject to any disclaimer, the term of this patent is extended or adjusted under 35 U.S.C. 154(b) by 263 days.

This patent is subject to a terminal disclaimer.

(21) Appl. No.: 14/397,020

(22) PCT Filed: Apr. 23, 2013

(86) PCT No.: PCT/EP2013/058355

§ 371 (c)(1),
(2) Date: Oct. 24, 2014

(87) PCT Pub. No.: WO2013/160281

PCT Pub. Date: Oct. 31, 2013

(65) Prior Publication Data

US 2015/0107309 A1 Apr. 23, 2015

(30) Foreign Application Priority Data

Apr. 24, 2012 (EP) ..... 12165291

(51) Int. Cl.
*D06F 39/00* (2006.01)
*D06F 39/02* (2006.01)
*D06F 39/08* (2006.01)

(52) U.S. Cl.
CPC ..... *D06F 39/007* (2013.01); *D06F 39/022* (2013.01); *D06F 39/028* (2013.01); *D06F 39/088* (2013.01)

(58) Field of Classification Search
CPC .... D06F 39/007; D06F 39/022; D06F 39/028; D06F 39/088; A47L 15/4229;
(Continued)

(56) References Cited

U.S. PATENT DOCUMENTS 2,619,825 A * 12/1952 Rosenkrans ..... D06F 1/08 137/172
3,204,767 A * 9/1965 Borochaner ..... A47L 15/4229 134/115 R (Continued)

FOREIGN PATENT DOCUMENTS

DE 3521598 A1 12/1986
DE 3527182 A1 2/1987

(Continued)

OTHER PUBLICATIONS

Machine Translation of Heissmeier, EP 3521598 A1, Dec. 1986.*

(Continued)

*Primary Examiner* — David G Cormier
(74) *Attorney, Agent, or Firm* — Banner & Witcoff, Ltd

(57) ABSTRACT

Laundry washing machine (1) includes an outer casing (2) and, inside said casing (2), a washing tub (3). A rotatable drum arranged in an axially rotating manner inside the washing tub (3) and is structured for receiving the laundry to be washed. A detergent dispensing assembly (9) is structured for supplying detergent into the washing tub (3). A first fresh-water supply circuit (10) is structured for selectively channeling a flow of fresh water from the water mains towards the detergent dispensing assembly (9) and/or the washing tub (3). A water softening device (11) which is interposed between the first fresh-water supply circuit (10) and the detergent dispensing assembly (9) or the washing tub (3), and is structured for reducing the hardness degree of the fresh water supplied to the washing tub (3). The detergent dispensing assembly (9), includes a detergent container (16)

(Continued)

which is provided with a number of detergent compartments (16*a*) each fillable with a respective detergent product, and a detergent flush circuit (18) which receives the fresh water from the water softening device (11) and is structured for selectively spilling/pouring the fresh water arriving from the water softening device (11) into any one of said detergent compartments (16*a*). The laundry washing machine (1) furthermore includes a second fresh-water supply circuit (44) which connects the water mains directly to the detergent flush circuit (18) of the detergent dispensing assembly (9), bypassing the water softening device (11), and which is structured so as to control/regulate the flow of fresh water from the water mains towards said detergent flush circuit (18).

18 Claims, 7 Drawing Sheets

(58) Field of Classification Search
CPC .. A47L 15/4231; C02F 1/42; C02F 2001/422; C02F 2001/425; C02F 2001/427
See application file for complete search history.

(56) References Cited

U.S. PATENT DOCUMENTS 4,379,057 A * 4/1983 Meiser ..... C02F 1/42 210/105
5,791,168 A * 8/1998 Smock ..... D06F 39/028 137/624.2
6,557,382 B1 * 5/2003 Koike ..... D06F 39/007 68/13 A
6,776,913 B1 * 8/2004 Jangbarwala ..... B01J 49/0086 210/191
2005/0224100 A1 10/2005 Maunsell et al.
2005/0229652 A1 * 10/2005 Kim ..... D06F 39/028 68/237
2007/0000292 A1 * 1/2007 Park ..... D06F 39/007 68/13 A
2007/0220927 A1 * 9/2007 Rizzetto ..... D06F 39/028 68/16
2009/0119849 A1 5/2009 Hill
2012/0060568 A1 3/2012 Buso

FOREIGN PATENT DOCUMENTS

DE 102010028756 A1 11/2011
EP 1085118 A2 3/2001
EP 1568815 A1 8/2005
EP 1607509 A1 12/2005
EP 2113602 A1 11/2009
FR 2688776 A1 9/1993
GB 1158007 A 7/1969
WO 1712622 A 12/2005
WO 2011154426 A1 12/2011

OTHER PUBLICATIONS

International Search Report dated Apr. 16, 2014 in corresponding International Application No. PCT/EP2013/058355.
International Search Report dated May 27, 2013 in related International Application No. PCT/EP2013/058214.
Feb. 16, 2016 (CN) First Office Action—App 201380022027.4.

* cited by examiner

LAUNDRY WASHING MACHINE

BACKGROUND

The present invention relates to a laundry washing machine.

In particular, the present invention relates to a front-loading home laundry washing machine, to which the following description refers purely by way of example without this implying any loss of generality.

As is known, currently marketed front-loading home laundry washing machines generally comprise: a substantially parallelepiped-shaped outer boxlike casing structured for resting on the floor; a substantially bell-shaped washing tub which is suspended in floating manner inside the casing, directly facing a laundry loading/unloading through opening realized in the front wall of the casing; a substantially cylindrical elastically-deformable bellows, which connects the front opening of the washing tub to a laundry loading/unloading opening formed in the front wall of the casing; a porthole door which is hinged to the front wall of the casing to rotate to and from a closing position in which the door closes the laundry loading/unloading opening in the front wall of the casing for watertight sealing the washing tub; a substantially cylindrical, bell-shaped revolving drum structured for housing the laundry to be washed, and which is housed inside the washing tub with its concavity facing the laundry loading/unloading opening and in axially rotating manner so as to be able to freely rotate about its substantially horizontally-oriented longitudinal axis; and finally an electrically-powered motor assembly which is structured for driving into rotation the revolving drum about its longitudinal axis inside the washing tub.

Like other home laundry washing machines, this type of laundry washing machines is furthermore provided with a fresh-water supply circuit structured for selectively drawing a fresh water from the water mains according to the washing cycle manually-selected by the user via a control panel generally located on the front wall of the boxlike casing, and channeling said water into the washing tub. Detergent dispensing assembly is generally located inside the boxlike casing, immediately above the washing tub, and is structured for selectively feeding into the washing tub. According to the washing cycle manually-selected by the user, a given amount of detergent, softener and/or other washing agent is suitably mixed with the fresh water arriving from the water mains.

This detergent dispensing assembly generally comprises a detergent drawer which is usually divided into a number of detergent compartments each structured for being manually fillable with a corresponding detergent product, and which is fitted/inserted in manually extractable manner into a completely recessed drawer housing whose entrance is located on front wall of the boxlike casing, above the porthole door. The bottom of the drawer housing instead directly communicates with the inside of the washing tub via a drain duct.

The fresh-water supply circuit is structured for drawing fresh water from the water mains and selectively and alternatively channeling said water into any one of the detergent compartments of the detergent drawer, so as to selectively flush the detergent, softener or other washing agent out of the compartment and down on the bottom of the drawer housing, and afterwards sweep the detergent, softener or other washing agent away from the bottom of the drawer housing directly into the washing tub.

As is known the hardness of the fresh water used for washing deeply negatively influences the cleaning efficiency of the detergents and softeners used in the washing cycle, thus the user is usually requested to considerably increase, when the hardness degree of the tap water is too high, the amount of detergent and softener used in the washing cycle and/or to mix the detergent with a given amount of very expensive, generally polycarboxylates-based, water-softening chemical product.

To solve this problem the European patent application No. 1085118 discloses a front-loading home laundry washing machine provided with an internal water softening device capable of reducing, during each washing cycle, the hardness degree of the tap water used in the pre-washing and washing phases of the washing cycle. This water softening device uses ion-exchange resins to restrain calcium and magnesium ions (Ca++ an Mg++) dissolved in the fresh water channeled to the washing tub, and uses brine (i.e. salt water) to periodically regenerate these ion-exchange resins. Salt water, in fact, is able to remove from the ion-exchange resins the calcium and magnesium ions previously combined/fixed to said resins.

Unluckily integration of the salt reservoir on the back of the detergent drawer has brought to a very complicated detergent-dispenser structure with a consequent significant increase in the detergent dispenser overall production cost. More specifically, in European patent application No. 1085118 the salt reservoir on the back of the detergent drawer is connected to the regeneration-resin container via a very complicated siphon assembly arranged at center of the same salt reservoir.

Moreover the capacity of the salt reservoir on the back of the detergent drawer is too limited for the everyday-use typical of a traditional home laundry washing machine. It is unacceptable for a normal user to refill the salt reservoir every 3-4 washing cycles. Furthermore the brine accidentally coming out of the salt reservoir accumulates on the bottom of the drawer housing which is in direct communication with the upper portion of the washing tub, thus the brine can reach quite easily the outer surface of the revolving drum that is generally made of metal, and therefore cause a quick rusting up of the revolving drum.

Moreover, the ion-exchange resins have a relatively short average lifetime due to the high frequency of the regeneration process. In fact all fresh water used in the washing-cycle crosses the internal water softening device for being softened.

Last but not less important, the internal water softening device disclosed in European patent application No. 1085118 has a very limited operation flexibility which narrows the number of different washing cycles on hand of the user.

Aim of the present invention is to realize an internal water softening device designed to eliminate the drawbacks referred above.

SUMMARY OF SELECTED INVENTIVE ASPECTS

In compliance with the above aims, according to the present invention there is provided a laundry washing machine comprising an outer casing and, inside said outer casing, a washing tub, a rotatable drum which is arranged in axially rotating manner inside the washing tub and is structured for receiving the laundry to be washed, a detergent dispensing assembly which is structured for supplying detergent into the washing tub, a first fresh-water supply circuit which is structured for selectively channeling a flow of fresh water from the water mains towards the detergent dispensing assembly and/or the washing tub, and a water softening device which is interposed between the first fresh-water supply circuit and the detergent dispensing assembly or the washing tub, and is structured for reducing the hardness degree of the fresh water supplied to the washing tub; wherein the detergent dispensing assembly comprises a detergent container which is provided with a plurality of detergent compartments each fillable with a respective detergent product, and a detergent flush circuit which receives the fresh water from the water softening device and is structured for selectively spilling/pouring the fresh water arriving from the water softening device into any one of said detergent compartments; and a second fresh-water supply circuit is provided, which connects the water mains to the detergent flush circuit of the detergent dispensing assembly, bypassing the water softening device, and which is structured so as to control/regulate the flow of fresh water from the water mains towards said detergent flush circuit so as to selectively spill/pour non-softened fresh water into any one of the detergent compartments of the detergent container, and/or so as to channel the non-softened fresh water towards the washing bypassing the detergent compartments of the detergent container.

Preferably, though not necessarily, the laundry washing machine is furthermore characterized by comprising an electrically-controlled hydraulic distributor or similar valve assembly which is arranged downstream of the water softening device, and is structured for selectively and alternatively channeling the softened fresh water arriving from the water softening device towards the various detergent compartments the detergent container; the second fresh-water supply circuit connecting the water mains to said electrically-controlled hydraulic distributor or similar valve assembly bypassing the water softening device.

Preferably, though not necessarily, the laundry washing machine is furthermore characterized in that the detergent flush circuit is structured for spilling/pouring a shower of water droplets by gravity into the various detergent compartments of the detergent container.

Preferably, though not necessarily, the laundry washing machine is furthermore characterized in that the detergent flush circuit of the detergent dispensing assembly comprises a sprinkler head which is located above the detergent container and is provided with a number of shower-making portions each of which is aligned to a corresponding detergent compartment of the detergent container and is structured for feeding a shower of water droplets by gravity only into said detergent compartment; and in that the electrically-controlled hydraulic distributor is located upstream of the sprinkler head, and is structured for channeling the fresh water selectively and alternatively towards the various shower-making portions of the sprinkler head.

Preferably, though not necessarily, the laundry washing machine is furthermore characterized in that the electrically-controlled hydraulic distributor or similar valve assembly is a rotatable hydraulic distributor.

Preferably, though not necessarily, the laundry washing machine is furthermore characterized in that the second fresh-water supply circuit comprises an electrically-controlled on-off valve which is fluidically interposed between the water mains and the inlet of the detergent flush circuit of the detergent dispensing assembly, and is able to control/regulate the flow of fresh water from the water mains towards the inlet of said drawer flush circuit.

Preferably, though not necessarily, the laundry washing machine is furthermore characterized in that the water softening device comprises: a water-softening agent container which is crossed by the fresh water arriving from the fresh-water supply circuit and is filled with a water softening agent able to reduce the hardness degree of the fresh water flowing through the same water-softening agent container; a regeneration-agent reservoir which is structured to receive a salt or other regeneration agent for performing a regeneration of the water softening function of the water softening agents stored into the water-softening agent container; and a water supply circuit which is structured for selectively channeling a given amount of fresh water into the regeneration-agent reservoir to form brine; and in that the water-softening agent container is interposed between the fresh-water supply circuit and the detergent flush circuit of the detergent dispensing assembly.

Preferably, though not necessarily, the laundry washing machine is furthermore characterized in the water softening device furthermore comprises an electrically-powered brine-circulating pump assembly which is interposed between the water-softening agent container and the regeneration-agent reservoir and is structured for moving/transferring the brine from the regeneration-agent reservoir to the water-softening agent container when activated, and for watertight sealing/isolating the regeneration-agent reservoir from the water-softening agent container when deactivated.

Preferably, though not necessarily, the laundry washing machine is furthermore characterized in that the water softening device furthermore comprises valve assembly which is interposed between the water-softening agent container and the regeneration-agent reservoir and which is structured for selectively allowing the brine to flow by gravity from the regeneration-agent reservoir to the water-softening agent container.

Preferably, though not necessarily, the laundry washing machine is furthermore characterized in that the regeneration-agent reservoir comprises a regeneration-agent container which is fillable with a given quantity of regeneration agents, and in that the water supply circuit of the water softening device is structured for selectively spilling/pouring a shower of water droplets by gravity into said regeneration-agent container.

Preferably, though not necessarily, the laundry washing machine is furthermore characterized in that the water supply circuit of the water softening device comprises a sprinkler head which is located above the regeneration-agent container and is structured for feeding a shower of water droplets by gravity into said regeneration-agent container; and a valve assembly which is located upstream of said sprinkler head and is structured for selectively channeling the fresh water arriving from the fresh-water supply circuit, or directly from the water mains, towards said sprinkler head.

Preferably, though not necessarily, the laundry washing machine is furthermore characterized in that the valve assembly of the water supply circuit of the water softening device is located downstream of the water-softening agent container so as to selectively channel towards the sprinkler head the fresh water coming out of the same water-softening agent container.

Preferably, though not necessarily, the laundry washing machine is furthermore characterized in that the water supply circuit of the water softening device branches off from the hydraulic distributor, and in that the electrically-controlled hydraulic distributor incorporates the valve assembly of the water supply circuit of the water softening device.

Preferably, though not necessarily, the laundry washing machine is furthermore characterized by also comprising a first water drain line which is connected to the electrically-controlled hydraulic distributor and is structured for channeling the brine or fresh water arriving from the water softening device into the washing tub, or into a drain sump that extends downwards from the bottom of the washing tub, or into a water filtering assembly that is interposed between the drain sump of the washing tub and the suction of a water circulating pump and of a water exhaust pump of the laundry washing machine, or into the water exhaust pump.

Preferably, though not necessarily, the laundry washing machine is furthermore characterized in that the water softening device additionally comprises a second water drain line which is structured for selectively draining the brine or fresh water out of the water-softening agent container and channeling said brine or fresh water directly into the washing tub, or into a drain sump that extends downwards from the bottom of the washing tub, or into a water filtering assembly that is interposed between the drain sump of the washing tub and the suction of a water circulating pump and of a water exhaust pump of the laundry washing machine, or into the water exhaust pump.

BRIEF DESCRIPTION OF THE DRAWINGS

A non-limiting embodiment of the present invention will now be described, by way of example, with reference to the accompanying drawings, in which.

DETAILED DESCRIPTION OF EXEMPLARY EMBODIMENTS

Figure 1:
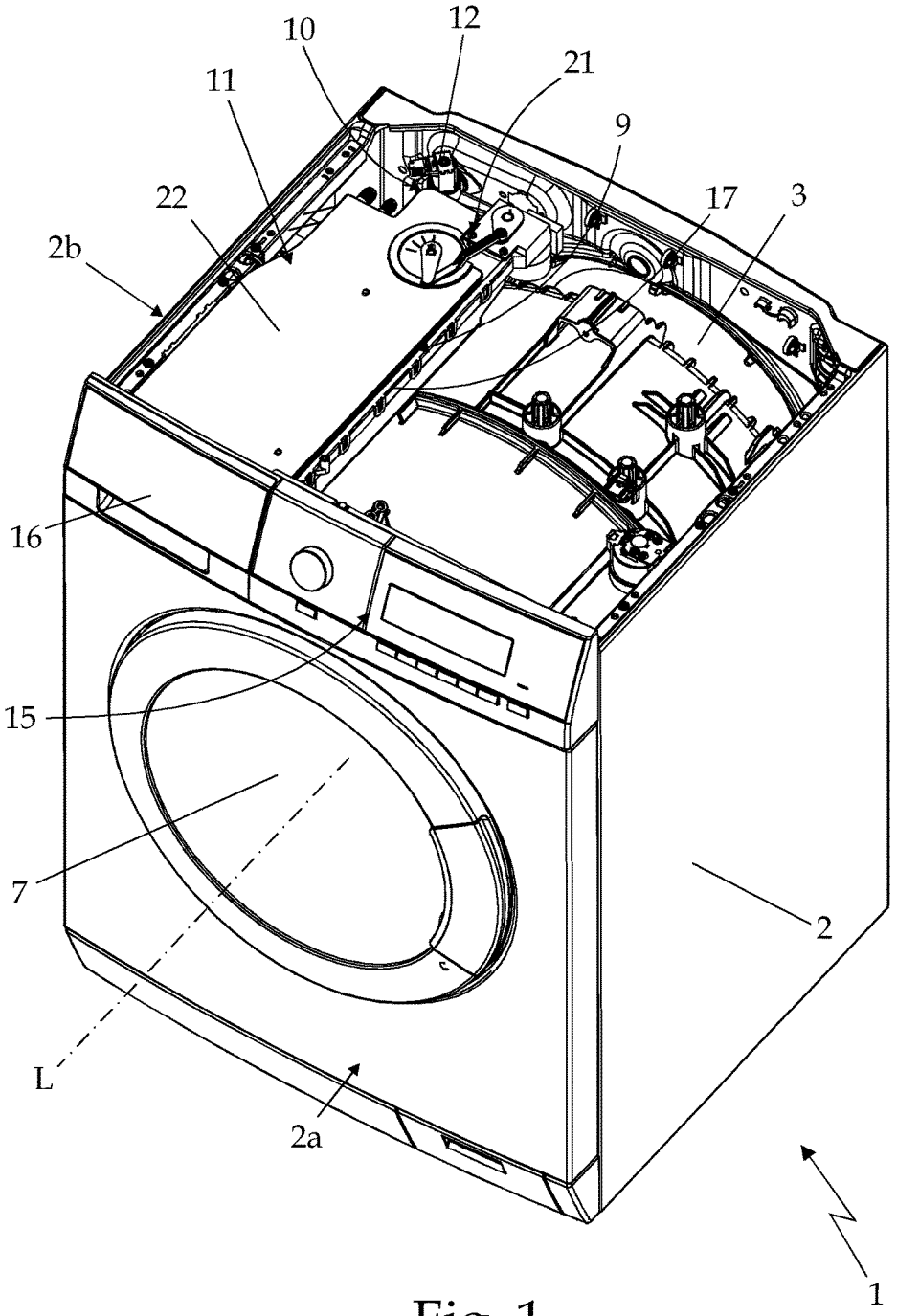
FIG. 1 is a perspective view of a front-loading, home laundry washing machine realized in accordance with the teachings of the present invention, with parts removed for clarity.

With reference to FIGS. 1, 2, 3 and 4, reference number 1 indicates as a whole a home laundry washing machine which comprises: a preferably, though not necessarily, substantially parallelepiped-shaped, rigid outer boxlike casing 2 which is structured for resting on the floor; a preferably substantially cylindrical, bell-shaped hollow washing tub 3 which is arranged inside the casing 2 with its opening or mouth directly facing a laundry loading/unloading pass-through opening realized in the front wall 2*a* of boxlike casing 2; a preferably substantially cylindrical, elastically-deformable bellows (not shown) watertight connecting the front opening or mouth of washing tub 3 to the laundry loading/unloading opening realized in the front wall 2*a* of casing 2; and a substantially cylindrical, bell-shaped revolving drum (not shown) structured for housing the laundry to be washed, and which is housed in axially rotating manner inside the washing tub 3 so as to be able to freely rotate about its longitudinal reference axis.

In the example shown, in particular, the revolving drum is housed in axially rotating manner inside the washing tub 3 with its front opening directly faced/aligned to the laundry loading/unloading opening on the front wall 2*a* of casing 2, and the drum rotation axis is preferably arranged locally substantially coincident with the substantially horizontally-oriented longitudinal reference axis L of washing tub 3.

Furthermore in the example shown the hollow washing tub 3 is preferably suspended in floating manner inside the casing 2 via a suspension system preferably, though not necessarily, comprising a couple of upper coil springs 4 connecting the upper portion of the washing tub 3 to the top of the boxlike casing 2, and a couple of lower vibration dampers 5 connecting the bottom portion of the washing tub 3 to the bottom of the boxlike casing 2.

With reference to FIGS. 1, 2, 3 and 4, the laundry washing machine 1 furthermore comprises:

- a porthole door 7 which is hinged to the front wall 2*a* of casing 2 to rotate about a preferably, though non necessarily, vertically-oriented reference axis to and from a closing position in which the peripheral border of the porthole door 7 rests completely on front wall 2*a* for closing the laundry loading/unloading opening and watertight sealing the washing tub 3;
- an electrically-powered motor assembly 8 which is structured for driving into rotation the revolving drum about its longitudinal reference axis inside the washing tub 3;
- a detergent dispensing assembly 9 which is housed inside the casing 2 in easily reachable manner by the user, and is structured for selectively feeding into the washing tub 3, according to the selected washing cycle, a given amount of detergent, softener and/or other washing agent suitably mixed with the fresh water arriving from the water mains, or even simply a given amount of fresh water arriving from the water mains; and
- a fresh-water supply circuit 10 which is arranged/interposed between the water mains and the detergent dispensing assembly 9 or between the water mains directly the washing tub 3, and is structured so as to control/regulate the flow of fresh water from the water mains towards the detergent dispensing assembly 9 and/or the washing tub 3.

In addition to the above, the laundry washing machine 1 furthermore comprises, inside casing 2, an internal water softening device 11 which is arranged/interposed between the fresh-water supply circuit 10 and the detergent dispensing assembly 9, so as to be crossed by the fresh water flowing from the water mains towards the detergent dispensing assembly 9, and is structured for selectively reducing, during each washing cycle, the hardness degree of the fresh water drawn from the water mains and channeled to the detergent dispensing assembly 9.

Figure 6:
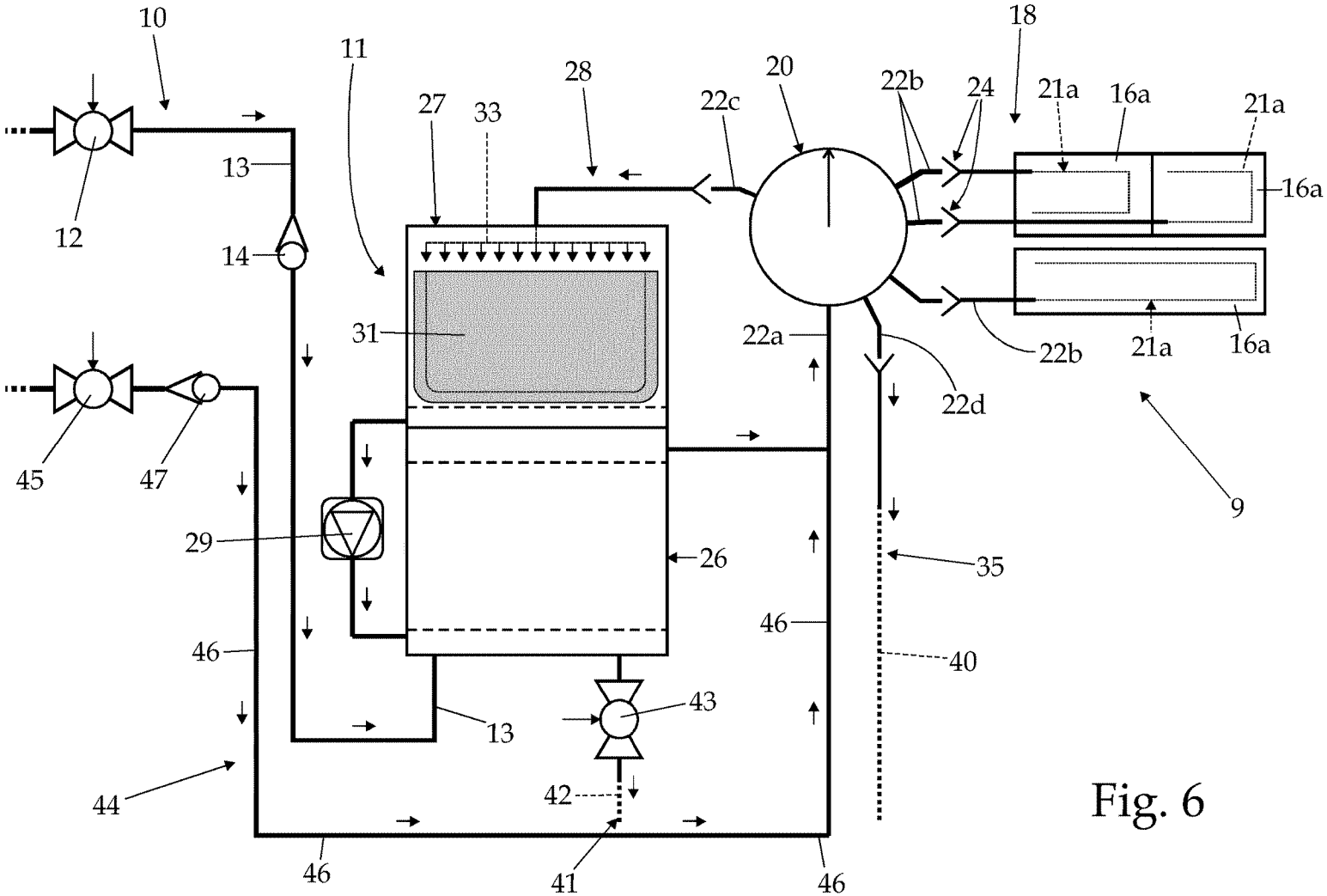
FIG. 6 is a schematic view of the FIG. 5 detergent dispensing assembly and water softening device.

With referenced to FIGS. 1 and 6, in the example shown, in particular, the fresh-water supply circuit 10 preferably comprises an electrically-controlled on-off valve 12 which is arranged/interposed between the water mains and the water softening device 11, and is able to control/regulate the flow of fresh water from the water mains towards the water softening device 11; and a hosepipe 13 connecting the on-off valve 12 directly to the inlet of the internal water softening device 11 which, in turn, has the outlet connected to the detergent dispensing assembly 9. In the example shown, in particular, the electrically-controlled on-off valve 12 is preferably attached to the rear wall of casing 2.

Furthermore the fresh-water supply circuit 10 is preferably also provided with a one-way valve 14 which is located immediately downstream of the on-off valve 12, i.e. between the on-off valve 12 and the inlet of the water softening device 11, and is structured to allow the fresh water to only flow along hosepipe 13 from the water mains to the water softening device 11 and not vice versa. The internal water softening device 11 is therefore located downstream of the electrically-controlled on-off valve 12, and also downstream of the one-way valve 14 if present.

With reference to FIGS. 1-6, the detergent dispensing assembly 9, in turn, is preferably housed inside the boxlike casing 2 immediately above the washing tub 3, so as to emerge from the front wall 2*a* of boxlike casing 2 above the laundry loading/unloading opening of casing 2, and preferably also beside the appliance control panel 15 which is located on front wall 2*a* of casing 2, above the laundry loading/unloading opening and immediately beneath the top wall of casing 2.

Preferably the detergent dispensing assembly 9 furthermore comprises a detergent drawer 16 which is fitted/inserted in manually extractable manner into a completely recessed drawer housing 17 which, starting from front wall 2*a* of casing 2, extends substantially horizontally inside the boxlike casing 2 while remaining above the washing tub 3, and communicates with the outside of casing 2 via a front entrance or opening 17*a* realized on front wall 2*a* of casing 2 immediately above the laundry loading/unloading opening. The detergent drawer 16 is therefore manually movable inside the drawer housing 17 in a preferably substantially horizontally-oriented, displacement direction between a working position (see FIG. 1) in which the detergent drawer 16 is completely recessed inside the drawer housing 17 preferably while at same time closing the front entrance or opening 17*a* of the same drawer housing 17, and a completely extracted position (see FIGS. 3 and 4) in which the detergent drawer 16 partly juts out from the front wall 2*a* of casing 2 through the front entrance or opening 17*a* of the drawer housing 17.

In the example shown, in particular, the detergent drawer 16 is preferably movable inside the drawer housing 17 along a substantially horizontally-oriented, displacement direction which is also locally substantially perpendicular to the front wall 2*a* of casing 2.

Figure 5:
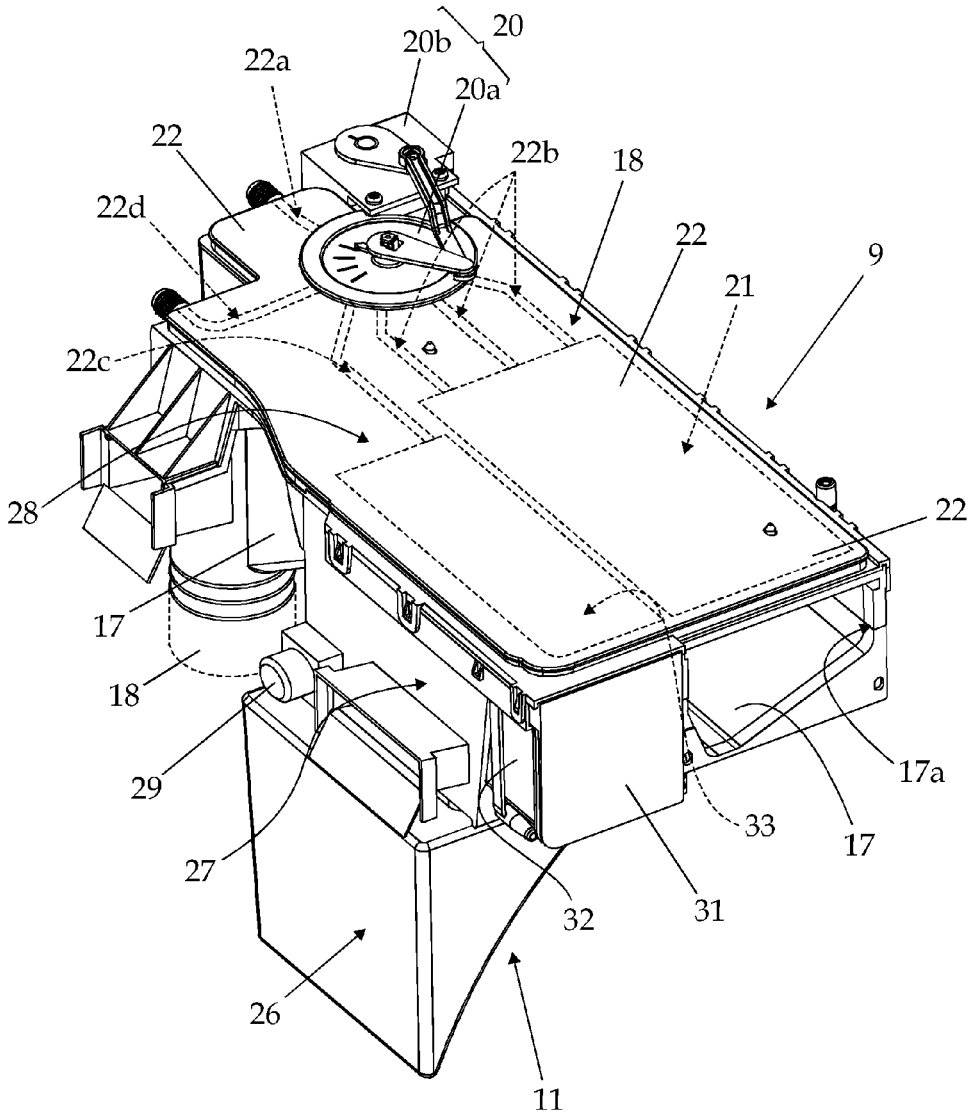
FIG. 5 is a perspective view of the internal detergent dispensing assembly and the internal water softening device of the FIG. 1 laundry washing machine.

With reference to FIGS. 5 and 6, the detergent dispensing assembly 9 furthermore comprises a drawer flush circuit 18 which is structured for selectively spilling/pouring a given amount of fresh water arriving from the water mains directly into the detergent drawer 16, so as to flush the detergent, softener or other washing agent out of the same detergent drawer 16 and down into the bottom portion of drawer housing 17; and a drain duct 19 which connects the bottom portion of drawer housing 17 to the inside of washing tub 3 for channeling this mixture of water and detergent, softener or other washing agent into the washing tub 3.

The water softening device 11 is interposed between the fresh-water supply circuit 10, i.e. the electrically-controlled on-off valve 12 or the one-way valve 14 if present, and the inlet of the drawer flush circuit 18 of the detergent dispensing assembly 9, so as to be crossed by the fresh water flowing from the water mains towards the drawer flush circuit 18.

In other words, the fresh-water supply circuit 10 is connected to the inlet of the internal water softening device 11, and the outlet of the internal water softening device 11 is connected to the inlet of the drawer flush circuit 18.

In the example shown, in particular, the bottom portion of drawer housing 17 is preferably shaped/structured so as to form a substantially funnel-shaped catchment basin which communicates with the inside of washing tub 3 via the drain duct 19. The drain duct 19, in turn, is preferably, though not necessarily, connected to the upper portion of washing tub 3.

Figure 3:
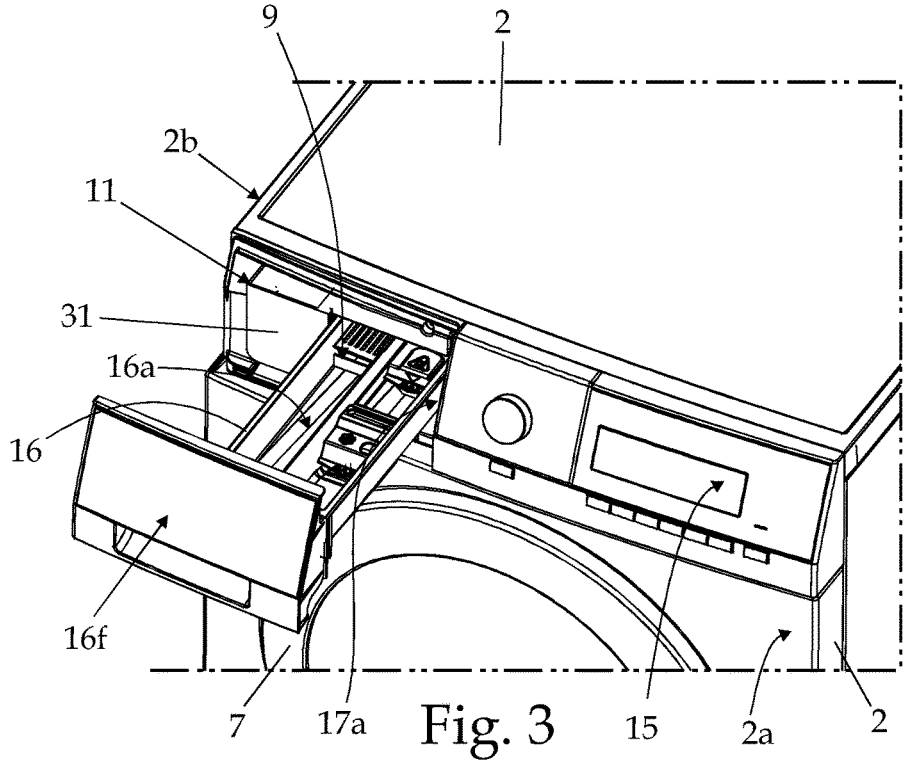
FIG. 3 is a perspective view of the top portion of the FIG. 1 laundry washing machine in a first operating position.
Figure 4:
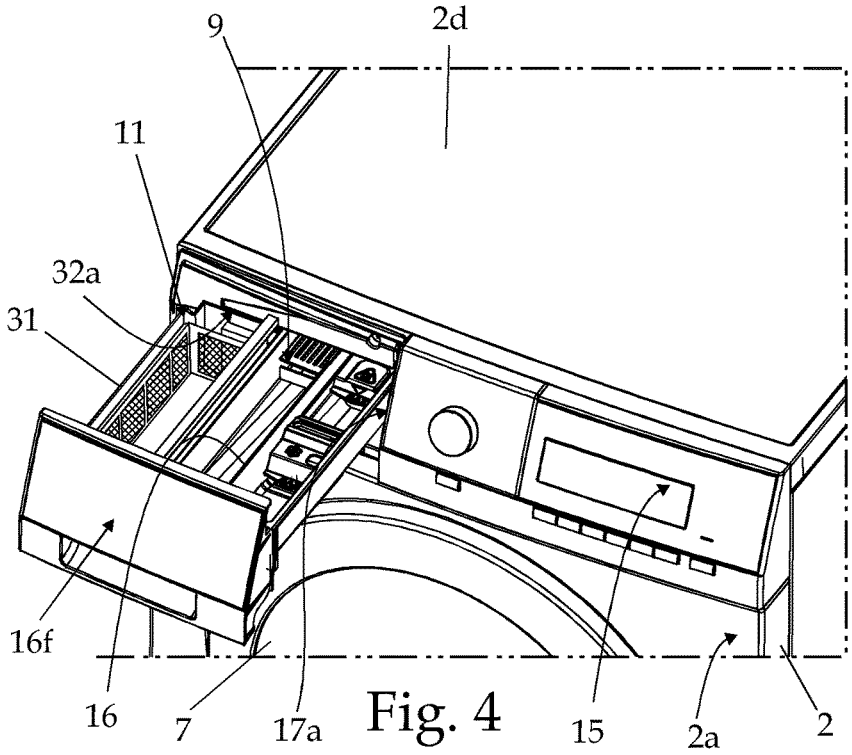
FIG. 4 is a perspective view of the top portion of the FIG. 1 laundry washing machine in a second operating position.

In addition to the above, with reference to FIGS. 3, 4 and 6, the detergent drawer 16 is divided into a number/plurality of detergent compartments 16*a* (three detergent compartments in the example shown) each of which is manually fillable with a respective washing agent; and the drawer flush circuit 18 is structured for spilling/pouring the softened fresh water arriving from water softening device 11 selectively and alternatively into any one of the detergent compartments 16*a* of the detergent drawer 16, so as to selectively flush the detergent, softener or other washing agent out of the same compartment 16*a* and down into the funnel-shaped catchment basin on the bottom of drawer housing 17.

In other words, the laundry washing machine 1 is provided with an electrically-controlled hydraulic distributor 20 or similar valve assembly, which is arranged downstream of the internal water softening device 11, i.e. between the outlet of the water softening device 11 and the various detergent compartments 16*a* of the detergent drawer 16, and is structured for selectively and alternatively channeling the softened fresh water arriving from the water softening device 11 towards the various detergent compartments 16*a* of detergent drawer 16.

In the example shown, in particular, the drawer flush circuit 18 is preferably structured for spilling/pouring a dense shower of water droplets by gravity into the various detergent compartments 16*a* of the detergent drawer 16.

With reference to FIGS. 5 and 6, in the example shown, in particular, the drawer flush circuit 18 of detergent dispensing assembly 9 is preferably structured for selectively and alternatively spilling/pouring a dense shower of water droplets by gravity into each detergent compartment 16*a* of detergent drawer 16, and preferably comprises:

- a sprinkler head 21 which is associated to the drawer housing 17 so as to be located immediately above the detergent drawer 16 when the latter is completely inserted/recessed into the same drawer housing 17, and which is provided with a number (three in the example shown) of shower-making portions/sections 21*a* each of which is preferably substantially aligned to a corresponding detergent compartment 16*a* of the detergent drawer 16 and is structured for feeding a dense shower of water droplets by gravity into the detergent compartment 16*a* located immediately beneath; and
- the electrically-controlled hydraulic distributor or valve assembly 20 which is located upstream of the sprinkler head 21, i.e. between the sprinkler head 21 and the water softening device 11, and is structured for channeling the softened fresh water arriving from the water softening device 11 selectively and alternatively towards the various shower-making sections/portions 21*a* of the sprinkler head 21.

In other words, the softened fresh water coming out from the water softening device 11 arrives to the hydraulic distributor 20 which channels/directs said softened fresh water selectively and alternatively towards one or more of the shower-making sections/portions 21*a* of the sprinkler head 21.

In the example shown, in particular, each shower-making section/portion 21*a* of sprinkler head 21 is preferably vertically aligned to a respective detergent compartment 16*a* of detergent drawer 16, and is preferably structured for feeding a dense shower of water droplets exclusively into the detergent compartment 16*a* located immediately beneath.

With reference to FIG. 5, in the example shown, in particular, the drawer housing 17 preferably comprises a substantially basin-shaped lower vessel which is connected to the inside of washing tub 3 via the drain duct 19, and a preferably substantially flat, upper lid or cover 22 which is structured to close the top of the basin-shaped lower vessel so as to be located immediately above the detergent drawer 16 when the latter is completely inserted/recessed into the drawer housing 17, and the sprinkler head 21 of drawer flush circuit 18 is preferably supported by said upper lid or cover 22.

In the example shown, in particular, the upper lid or cover 22 is preferably structured so as to incorporate the sprinkler head 21 of the drawer flush circuit 18.

In other words, an area of the upper lid or cover 22 of drawer housing 17 forms the sprinkler head 21 of the drawer flush circuit 18, and is therefore divided into a number (three in the example shown) of shower-making portions, each of which is vertically aligned to a corresponding detergent compartment 16*a* of the detergent drawer 16, and is structured for receiving the fresh water from the electrically-controlled hydraulic distributor 20 and for feeding a dense shower of water droplets by gravity exclusively into the detergent compartment 16*a* located immediately beneath.

With reference to FIG. 5, alike the sprinkler head 21, in the example shown the hydraulic distributor 20 is preferably, though not necessarily, incorporated into the upper lid or cover 22 of drawer housing 17. In an alternative embodiment the electrically-controlled hydraulic distributor 20 may be arranged inside the boxlike casing 2, far away from the upper lid or cover 22 of drawer housing 17 directly supporting the sprinkler head 21.

More in particular, in the example shown the electrically-controlled hydraulic distributor 20 preferably, though not necessarily, consists in an electrically-controlled rotatable hydraulic distributor 20 which is located immediately upstream of the sprinkler head 21, i.e. between the sprinkler head 21 and the water softening device 11, and is structured for channeling the fresh water arriving from the water softening device 11 selectively and alternatively towards the various shower-making sections/portions 21*a* of the sprinkler head 21.

Furthermore the rotatable hydraulic distributor 20 preferably, though not necessarily, comprises: a rotatable water diverter 20*a* which is recessed in axially rotating manner into the upper lid or cover 22; and an electric motor or other electrically-operated rotatable actuator 20*b* which is fixed to the lid or cover 22 beside of the rotatable water diverter 20*a*, and is mechanically connected to the central shaft of the rotatable water diverter 20*a* preferably, though not necessarily, via a crank-rod mechanism, so to directly control/vary the angular position of the rotatable water diverter 20*a*.

The upper lid or cover 22 of drawer housing 17, in turn, is preferably provided with a first internal water channel 22*a* that connects the inlet of the rotatable water diverter 20*a* to the outlet of the water softening device 11 so as to channel the fresh water arriving from the water softening device 11 directly to the inlet of the rotatable water diverter 20*a*; and a number of second internal water channels 22*b* each connecting a respective outlet of the rotatable water diverter 20*a* to a corresponding shower-making portion 21*a* of the sprinkler head 21, i.e. to a corresponding shower-making portion of the upper lid or cover 22.

The softened fresh water from the water softening device 11 therefore arrives to the inlet of the rotatable water diverter 20*a* and is selectively channeled/directed to one of the shower-making portions of the upper lid or cover 22 according to the angular position of the rotatable water diverter 20*a*.

In a different non-shown embodiment, the electrically-controlled hydraulic distributor 20 may consists of an appropriate number of electrically-controlled on-off valves which are preferably, though not necessarily, incorporated into the upper lid or cover 22 of the drawer housing 17, and each of which is interposed between the outlet of the water softening device 11 and a respective shower-making section/portion 21*a* of the sprinkler head 21 for directly controlling the flow of softened fresh water towards the corresponding shower-making section/portion 21*a* of the sprinkler head 21.

Moreover, the drawer flush circuit 18 is preferably additionally provided with a number of air-break assemblies 24 each located immediately downstream of a corresponding water outlet of the rotatable water diverter 20*a*, i.e. along a corresponding second internal water channel 22*b* of the upper lid or cover 22 of the drawer housing 17.

With reference to FIGS. 1-6, the internal water softening device 11 instead is preferably housed inside the boxlike casing 2 preferably immediately beside the detergent dispensing assembly 9, so that both the detergent dispensing assembly 9 and the water softening device 11 are directly exposed or exposable on the outside of boxlike casing 2, one beside the other, for being preferably independently accessible by the user at any moment.

The water softening device 11 furthermore basically comprises a water-softening agent container 26 and a regeneration-agent reservoir 27.

The water-softening agent container 26 is crossed by the fresh water arriving from the fresh-water supply circuit 10, and is filled with a water softening agent able to reduce the hardness degree of the fresh water flowing through the same water-softening agent container 26. More in particular, the water-softening agent container 26 has an inlet connected to the fresh-water supply circuit 10 and an outlet connected to the detergent dispensing assembly 9, so as to be crossed by the fresh water flowing from the water mains to the detergent dispensing assembly 9.

The water-softening agent container 26 is therefore fluidically interposed between the fresh-water supply circuit 10 and the detergent dispensing assembly 9, or more specifically between the fresh-water supply circuit 10 and the inlet of the drawer flush circuit 18 of detergent dispensing assembly 9, so as to be crossed by the fresh water flowing from the water mains to the inlet of the drawer flush circuit 18.

The regeneration-agent reservoir 27 instead is fluidically connected to the water-softening agent container 26 and is structured for receiving a given quantity of salt or other regeneration agent which is able to regenerate the water softening function of the water softening agents stored inside the water-softening agent container 26.

The water-softening agent container 26 and the regeneration-agent reservoir 27 are both housed inside the casing 2, and the regeneration-agent reservoir 27 is furthermore preferably arranged inside the casing 2 immediately adjacent to the detergent dispensing assembly 9 in a direction locally substantially parallel to the front wall 2*a* of casing 2, so that both the detergent dispensing assembly 9 and the regeneration-agent reservoir 27 of the water softening device 11 are directly exposed or exposable on the outside of boxlike casing 2, one beside the other, for being preferably independently accessible by the user at any moment.

In particular, the regeneration-agent reservoir 27 of the water softening device 11 is preferably housed inside the boxlike casing 2 immediately adjacent to the drawer housing 17, preferably on the side of the drawer housing 17 directly faced to the adjoining side wall 2*b* of boxlike casing 2, and is provided with a corresponding independent inlet which is exposed or exposable to the outside of the boxlike casing 2 beside the inlet of detergent dispensing assembly 9, i.e. beside the front entrance or opening 17*a* of the drawer housing 17. This independent inlet is suitable for loading the salt or other regeneration agents inside the regeneration-agent reservoir 27.

In other words, the regeneration-agent reservoir 27 of water softening device 11 comprises a regeneration-agent container which is manually fillable with a given quantity of regeneration agents and is housed inside the casing 2 into a corresponding second outer housing, and the front wall 2*a* of the boxlike casing 2 is provided with a second pass-through opening through which the regeneration-agent container is accessible by the user.

Preferably this independent inlet of the regeneration-agent reservoir 27 is furthermore located on the front wall 2*a* of boxlike casing 2 immediately adjacent to the inlet of detergent dispensing assembly 9, i.e. immediately adjacent to the front entrance or opening 17*a* of the drawer housing 17.

With reference to FIGS. 1-6, the water softening device 11 in particular comprises:

a water-softening agent container 26 which is filled with a given amount of ion-exchange resins (not shown) capable to restrain the calcium and/or magnesium ions (Ca++ an Mg++) dissolved in the fresh water flowing across the same agent container 26, and which is interposed between the fresh-water supply circuit 10, i.e. the on-off valve 12 or the one-way valve 14 if present, and the drawer flush circuit 18 of the detergent dispensing assembly 9; and an outside-accessible regeneration-agent reservoir 27 which is structured for receiving a given amount (for example half a Kilo or one Kilo) of salt grains (Sodium Chloride) or similar regeneration chemical agent, and is housed inside the boxlike casing 2 preferably immediately adjacent the drawer housing 17 of detergent dispensing assembly 9 in a direction substantially parallel to the front wall 2*a* of casing 2, so to emerge from a corresponding pass-through opening realized on the front wall 2*a* of the boxlike casing 2 immediately beside the entrance/front opening 17*a* of the drawer housing 17.

The ion-exchange resins (not shown) stored into the water-softening agent container 26 form the water softening agents of the water softening device 11.

More specifically, the water-softening agent container 26, hereinafter also referred to as the resin container 26, is interposed between the fresh-water supply circuit 10, i.e. the on-off valve 12 or the one-way valve 14 if present, and the inlet of the hydraulic distributor 20, so to be crossed by the fresh water flowing from the on-off valve 12 to the inlet of drawer flush circuit 18.

Preferably, though not necessarily, the water-softening agent container 26 of the water softening device 11, i.e. the resin container 26, is furthermore located beneath the regeneration-agent reservoir 27.

In addition to the above, with reference to FIGS. 5 and 6, the water softening device 11 furthermore comprises:

a water supply circuit 28 which is structured for channeling, on command, a given amount of fresh water into the regeneration-agent reservoir 27 so to at least partly dissolve the salt or other regeneration agents stored therein and form a given amount of brine (i.e. salt water); and an electrically-powered brine-circulating pump 29 which is interposed between the water-softening agent container 26 and the regeneration-agent reservoir 27 and is structured for transferring/moving, when activated, the brine (i.e. the salt water) from the regeneration-agent reservoir 27 to the water-softening agent container 26, and for completely watertight sealing/isolating, when deactivated, the regeneration-agent reservoir 27 from the water-softening agent container 26 so as to prevent the brine (i.e. the salt water) store in the regeneration-agent reservoir 27 from flowing towards the water-softening agent container 26.

More specifically, the water supply circuit 28 is preferably structured for selectively spilling/pouring, on command, a dense shower of water droplets by gravity into the regeneration-agent reservoir 27, so to at least partly dissolve the salt or other regeneration agents stored therein and form a given amount of brine (i.e. salt water).

With reference to FIGS. 2, 3, 4 and 5, in the example shown, in particular, the regeneration-agent reservoir 27 preferably comprises a salt drawer 31 which is dimensioned for being manually fillable with said given amount of salt grains or other water-softening chemical agent, and is fitted/inserted in manually extractable manner into a completely recessed second drawer housing 32 which, starting from front wall 2*a* of casing 2, extends substantially horizontally inside the boxlike casing 2 immediately beside the drawer housing 17 of the detergent dispensing assembly 9, while remaining above the washing tub 3. The drawer housing 32 furthermore communicates with the outside of casing 2 via a corresponding front entrance or opening 32*a* which is preferably realized on front wall 2*a* of casing 2 locally immediately adjacent to the entrance or front opening 17*a* of the drawer housing 17 of the detergent dispensing assembly 9.

Like detergent drawer 16, the salt drawer 31 of regeneration-agent reservoir 27 is manually movable inside the drawer housing 32 in a preferably substantially horizontally-oriented, displacement direction between a working position (see FIG. 3) in which the salt drawer 31 is completely recessed inside the corresponding drawer housing 32 preferably while at same time closing the front entrance or opening 32*a* of the same drawer housing 32, and a completely extracted position (see FIG. 4) in which the salt drawer 31 partly juts out from the front wall 2*a* of casing 2 through the front entrance or opening 32*a* of the corresponding drawer housing 32.

The displacement direction of the salt drawer 31 is furthermore preferably locally substantially parallel to the displacement direction of detergent drawer 16, thus detergent drawer 16 and salt drawer 31 are able to jut out from the front wall 2*a* of casing 2 while remaining locally substantially parallel to one another.

In the example shown, in particular, the salt drawer 31 is preferably fixed to/supported by a longitudinal rail or telescopic runner (not shown) which is arranged into the drawer housing 32 locally substantially parallel to the insertion and extraction direction of the salt drawer 31, so as to allow the manual displacement of the salt drawer 31 in and out of the drawer housing 32. Preferably a push-pull mechanism (not shown) is also arranged into the drawer housing 32 to ease the manual insertion and extraction of salt drawer 31.

Like the bottom portion of drawer housing 17, the bottom portion of drawer housing 32 is preferably shaped/structured so as to form a substantially funnel-shaped catchment basin wherein the brine accumulates, and the suction of the brine-circulating pump 29 directly communicates with the bottom of drawer housing 32 so that the brine-circulating pump 29 is able to selectively pump the brine from the funnel-shaped catchment basin of drawer housing 32 to the resin container 26.

Lastly, with reference to FIG. 5, the drawer housing 32 of the regeneration-agent reservoir 27 is preferably, though not necessarily, realized in one piece with the drawer housing 17 of the detergent dispensing assembly 9.

With reference to FIGS. 4, 5 and 6, the water supply circuit 28 of water softening device 11, in turn, is preferably structured for spilling/pouring a dense shower of the water droplets by gravity directly into the salt drawer 31 when the salt drawer 31 is completely inserted into the drawer housing 32, and the bottom and/or at least one of sidewalls of the salt drawer 31 have a water-permeable structure, so as to form the brine directly into the substantially funnel-shaped catchment basin on the bottom of drawer housing 32.

In the example shown, in particular, the bottom and at least one of the two longer sidewalls of salt drawer 31 have a meshed structure so as to allow the fresh water spilled/poured into the salt drawer 31 to freely reach and at least partly dissolve the salt grains located inside the salt drawer 31 to form a given amount of brine which drops directly on the funnel-shaped catchment basin present on the bottom of drawer housing 32.

Furthermore, with reference to FIGS. 1, 3 and 4, in the example shown the front panel 16*f* of the detergent drawer 16 is preferably substantially handle-shaped and is preferably dimensioned so to completely cover, when the detergent drawer 16 is completely inserted into the drawer housing 17, both the entrance/front opening 17*a* of drawer housing 17 and the entrance/front opening 32*a* of drawer housing 32, so to completely hide both the detergent dispensing assembly 9 and the internal water softening device 11.

With reference to FIGS. 5 and 6, alike the drawer flush circuit 18, the water supply circuit 28 of water softening device 11 preferably comprises:

- a sprinkler head 33 which is associated to the drawer housing 32 so as to be located immediately above the salt drawer 31 when the latter is completely inserted/recessed into the drawer housing 32, and it is provided with a shower-making portion/section that preferably, though not necessarily, extends above the whole salt drawer 31, and is structured for feeding a dense shower of water droplets by gravity into the salt drawer 31; and
- a valve assembly which is located immediately upstream of the sprinkler head 33 and is structured for selectively channeling the fresh water arriving from the fresh-water supply circuit 10 towards the sprinkler head 33.

Preferably, though not necessarily, the valve assembly of water supply circuit 28 is furthermore located downstream of the resin container 26 so as to selectively channel towards the sprinkler head 33 the softened fresh water coming out of the resin container 26.

In the example shown, in particular, the drawer housing 32 preferably comprises a substantially basin-shaped lower vessel which is preferably arranged immediately adjacent/adjoining the substantially basin-shaped lower vessel of drawer housing 17, and the upper lid or cover 22 of drawer housing 17 is preferably shaped/structured to additionally extend above the basin-shaped lower vessel of drawer housing 32 for closing the top of the substantially basin-shaped lower vessel of drawer housing 32. The drawer housing 32 is therefore upwardly delimited by a portion of the upper lid or cover 22 of the detergent dispensing assembly 9.

In other words, the drawer housing 32 of the regeneration-agent reservoir 27 is formed by a substantially basin-shaped lower vessel and by a portion of the upper lid or cover 22 of drawer housing 17.

In the example shown, in particular, the basin-shaped vessel of drawer housing 32 is preferably realized in one piece with the basin-shaped lower vessel of drawer housing 17.

Preferably the portion of the upper lid or cover 22 forming the drawer housing 32 is furthermore structured for supporting at least the sprinkler head 33 of the water supply circuit 28.

With reference to FIG. 5, in the example shown, in particular, the upper lid or cover 22 of drawer housing 17 is preferably structured to also incorporate at least part of the water supply circuit 28 of the water softening device 11.

In particular, the upper lid or cover 22 of drawer housing 17, 32 is preferably structured so to also incorporate the sprinkler head 33 of the water supply circuit 28. Therefore the upper lid or cover 22 forms a water delivery member 22 that incorporates at least part of the detergent flush circuit 18, i.e. the sprinkler head 21 of the detergent flush circuit 18, and at least part of the water supply circuit 28, i.e. the sprinkler head 33 of the water supply circuit 28.

With reference to FIG. 6, moreover in the example shown the water supply circuit 28 of water softening device 11 preferably branches off from the hydraulic distributor 20.

In particular, the water supply circuit 28 of the internal water softening device 11 preferably branches off from the drawer flush circuit 18 of the detergent dispensing assembly 9. In other words, the water supply circuit 28 of the water softening device 11 is preferably fluidically connected to the electrically-controlled hydraulic distributor 20, and the valve assembly of the water supply circuit 28 is incorporated into the same electrically-controlled hydraulic distributor 20.

In the example shown, in fact, the upper lid or cover 22 is preferably provided with a third internal water channel 22*c* which extends inside the same upper lid or cover 22 from a corresponding outlet of the rotatable water diverter 20*a* of the hydraulic distributor 20, and ends into the sprinkler head 33 so as to channel the fresh water coming out of the rotatable water diverter 20*a* directly into the salt drawer 31.

The electric motor 20*b* of hydraulic distributor 20, in turn, is structured to selectively place/arrange the rotatable water diverter 20*a* in a position that allows, when the brine is requested, to channel the fresh water arriving from the resin container 26 to the third internal water channel 22*c* of the upper lid or cover 22.

In other words, the water supply circuit 28 comprises a third internal water channel 22*c* that branches off from a corresponding outlet of the hydraulic distributor 20 of drawer flush circuit 18, and extends inside the upper lid or cover 22 up to reach the sprinkler head 33 immediately above the salt drawer 31, so as to feed a shower of water droplets into the regeneration-agent reservoir 27 under direct control of the hydraulic distributor 20.

With reference to FIGS. 5 and 6, in the example shown the laundry washing machine 1 is preferably also provided with a first water drain line 35 which is connected to a corresponding outlet of the electrically-controlled hydraulic distributor 20 or similar valve assembly, and is structured for channeling the brine or fresh water arriving from the resin container 25 preferably directly into the washing tub 3 bypassing the detergent compartments 16*a*. As an alternative, the first water drain line 35 is structured for channeling the brine or fresh water arriving from the resin container 26 preferably into the drain sump 36 that extends downwards from the bottom of the washing tub 3; or into the water filtering assembly 37 that is interposed between the drain sump 36 of washing tub 3 and the suction of the water circulating pump 38 and/or of the water exhaust pump 39 which, in the example shown, are both preferably located on the bottom of casing 2; or substantially directly into the water exhaust pump 39 which drains the waste water or washing liquor outside of the laundry washing machine 441; or in any case into the waste-water drain line that channels the waste water or washing liquor outside the laundry washing machine 1.

In other words, one of the outlets of the rotatable water diverter 20*a* of hydraulic distributor 20 is preferably connected to an auxiliary water drain line 35 which preferably, though not necessarily, ends into the washing tub 3, or into the drain sump 36, or into the water filtering assembly 37, or into the water exhaust pump 39; and the electric motor 20*b* is structured to selectively place/arrange the rotatable water diverter 20*a* in a position that allows to channel the brine or fresh water arriving from the resin container 26 to the water drain line 35 which, in turn, channels said brine or fresh water directly into the washing tub 3, or into the drain sump 36, or into the water filtering assembly 37, or into the water exhaust pump 39.

In the example shown, in particular, the upper lid or cover 22 of detergent dispensing assembly 9 is preferably provided with a fourth internal water channel 22*d* which extends inside the upper lid or cover 22 from a corresponding outlet of the rotatable water diverter 20*a*, to the inlet of a hosepipe 40 or the like that extend towards the bottom of casing 2 and ends directly into the washing tub 3, or into the drain sump 36, or into the water filtering assembly 37, or into the water exhaust pump 39.

Preferably, in addition to the hosepipe 40 and the fourth internal water channel 22*d*, the auxiliary water drain line 35 may also comprise a corresponding air-break assembly arranged along the fourth internal water channel 22*d* of the upper lid or cover 22.

With reference to FIG. 5, the brine-circulating pump 29 of the water softening device 11 is instead preferably, though not necessarily, incorporated/located on the bottom of drawer housing 32, i.e. on the bottom of the regeneration-agent reservoir 27, and preferably consists in a peristaltic pump 29 or other type of volumetric pump specifically structured for transferring/moving, when activated, the brine (i.e. the salt water) from the regeneration-agent reservoir 27 to the water-softening agent container 26, and for completely sealing/isolating, when deactivated, the regeneration-agent reservoir 27 from the water-softening agent container 26 so as to prevent the brine (i.e. the salt water) store in the regeneration-agent reservoir 27 from flowing towards the water-softening agent container 26.

Figure 2:
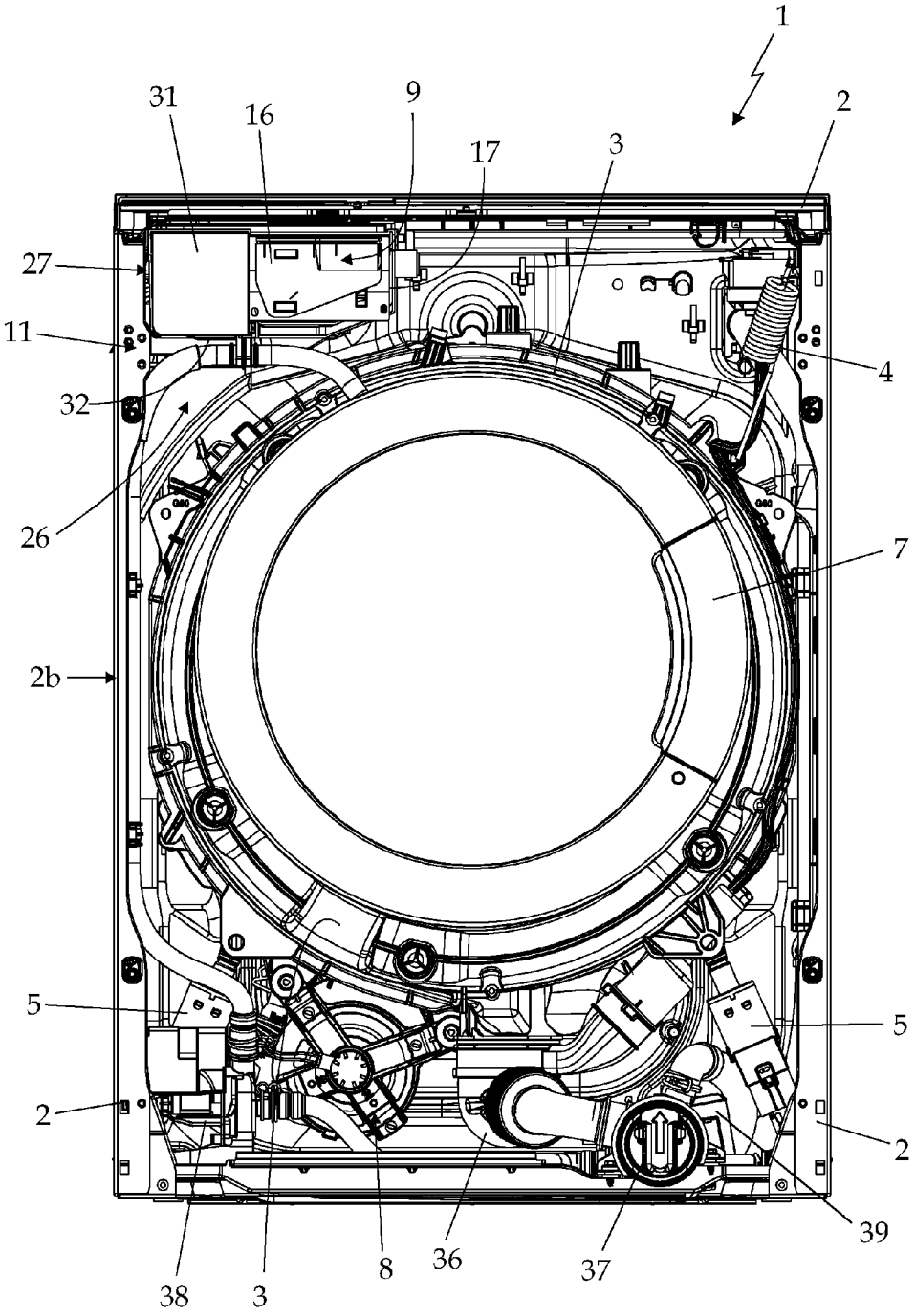
FIG. 2 is a front view of the FIG. 1 laundry washing machine with parts removed for clarity.

With reference to FIGS. 2, 4 and 5, the resin container 26, in turn, is located inside the casing 2 preferably, though not necessarily, immediately beneath the regeneration-agent reservoir 27 and immediately beside the upper portion of washing tub 3, so as to internally face the front wall 2*a* of casing 2.

In other words, the resin container 26 is preferably located below the drawer housing 17 of detergent dispensing assembly 9, laterally staggered with respect to the same drawer housing 17, and within an approximately triangular pocket seat or compartment delimited by the sidewall 2*b* of the boxlike casing 2, the upper portion of the washing tub 3, the front wall 2*a* of casing 2, and the drain duct 19 connecting the drawer housing 17 to the washing tub 3.

Moreover, the resin container 26 is preferably realized as a completely stand-alone modular component-part or cartridge 26 which is provided with mechanical coupling members (not shown) structured for allowing a rigid and stable, though easily releasable, fastening of the stand-alone modular component-part or cartridge 26 directly to the bottom of the regeneration-agent reservoir 27, and with hydraulic connectors (not shown) structured for allowing the stable, though easily removable, fluidical connection of the stand-alone modular component-part or cartridge 26 to the fresh water supply circuit 10, to the detergent dispensing assembly 9, and to the outlet of the brine-circulating pump 29.

More in particular, a first hydraulic connector (not shown) of the stand-alone modular component-part or cartridge 26 is structured to directly communicate with the on-off valve 12, or the one-way valve 14 if present, so as to allow the inflow of the fresh water into the resin container 26. A second hydraulic connector (not shown) of the stand-alone modular component-part or cartridge 26 is structured to directly communicate with the inlet of the drawer flush circuit 18 so as to allow the outflow of the fresh water from the resin container 26 towards the hydraulic distributor 20. A third hydraulic connector (not shown) of the stand-alone modular component-part or cartridge 26 is structured to directly communicate with the outlet of the brine-circulating pump 29 so as to allow the controlled inflow of the brine (i.e. the salt water) into the resin container 26.

In addition to the above, the ion-exchange resins (not shown) are preferably, though not necessarily, confined inside the resin container 26, into a water-permeable basket (not shown) whose volume is less than that of the resin container 26 so as to form an internal peripheral gap or interspace allowing free fresh-water circulation.

With reference to FIGS. 5 and 6, the internal water softening device 11 preferably additionally comprises a second water drain line 41 which fluidically connects the resin container 26, i.e. the water-softening agent container 26, either to the washing tub 3, or to the drain sump 36, or to the water filtering assembly 37, or substantially directly into the water exhaust pump 39 that drains the waste water or washing liquor outside the laundry washing machine 1, and it is structured for selectively draining the brine or fresh water out of the resin container 26 and channeling said brine or fresh water directly into the washing tub 3, or into the drain sump 36, or into the water filtering assembly 37, or substantially directly into the water exhaust pump 39 that drains the waste water or washing liquor outside the laundry washing machine 1.

In the example shown, in particular, the second water drain line 41 preferably comprises a hosepipe 42 which directly connects the bottom of the resin container 26 to the washing tub 3, or to the drain sump 36, or to the water filtering assembly 37, or to water exhaust pump 39; and an electrically-controlled on-off valve 43 which is located along the hosepipe 42 for controlling the outflow of the brine or fresh water from the resin container 26.

Lastly the internal water softening device 11 is preferably also provided with water-hardness sensor means (not shown) structured for measuring the hardness degree of the fresh water coming out from the resin container 26, i.e. the water-softening agent container 26, directed towards the detergent dispensing assembly 9.

In the example shown, in particular, the water-hardness sensor means are able to communicate with an internal electronic central control unit (not shown) which controls all electrically-operated component parts of the laundry washing machine 1, and is housed inside the boxlike casing 2, preferably on the back of the control panel 15 located on front wall 2*a*.

With reference to FIG. 6, the laundry washing machine 1 is finally provided with a second fresh-water supply circuit 44 which connects the water mains directly to the inlet of the drawer flush circuit 18 of detergent dispensing assembly 9 bypassing the water softening device 11, and is structured so to selectively channel to the inlet of the drawer flush circuit 18 a second flow of fresh water of the water mains. This second fresh-water supply circuit 44 therefore is able to channel the fresh water of the water mains directly towards the inlet of drawer flush circuit 18 independently from the fresh-water supply circuit 10. Furthermore, if the water drain line 35 is present, the second fresh-water supply circuit 44 is also able to channel the non-softened fresh water directly to the washing tub 3 via the water drain line 35 bypassing all detergent compartments 16*a* of the detergent drawer 16.

In other words, the fresh-water supply circuit 44 is able to channel the fresh water of the water mains directly towards the electrically-controlled hydraulic distributor 20 or similar valve assembly, bypassing the water softening device 11. The electrically-controlled hydraulic distributor 20 then channels this non-softened fresh water selectively and alternatively towards the various detergent compartments 16*a* of the detergent drawer 16 according the washing cycle selected by the user.

Likewise the fresh-water supply circuit 10, the second fresh-water supply circuit 44 preferably comprises:

- a second electrically-controlled on-off valve 45 which is fluidically interposed between the water mains and the inlet of the hydraulic distributor 20, i.e. the inlet of the drawer flush circuit 18 of detergent dispensing assembly 9, and is able to control/regulate the flow of fresh water from the water mains towards the inlet of the hydraulic distributor 20, i.e. towards the inlet of the drawer flush circuit 18 or rather the entrance of the first internal water channel 22*a* of the upper lid or cover 22; and preferably also
- a hosepipe or the like 46 connecting the on-off valve 45 directly to the inlet of the electrically-controlled hydraulic distributor 20, i.e. to the inlet of the drawer flush circuit 18 of detergent dispensing assembly 9 or rather the entrance of the first internal water channel 22*a* of the upper lid or cover 22, bypassing the resin container 26.

Furthermore the second fresh-water supply circuit 44 preferably also comprises a second one-way valve 47 which is located downstream of the on-off valve 45, and is structured to allow the fresh water to only flow along the hosepipe 46, from the water mains to the inlet of the hydraulic distributor 20, i.e. to the inlet of the drawer flush circuit 18 of detergent dispensing assembly 9, and not vice versa.

General operation of home laundry washing machine 1 is clearly inferable from the above description. When the on-off valve 12 is opened the fresh water flows from the water mains to the resin container 26 of the internal water softening device 11, wherein the ion-exchange resins reduce the hardness degree of the fresh water directed to the detergent dispensing assembly 9. The water-hardness sensor means monitor the hardness degree of the fresh water directed to the detergent dispensing assembly 9.

After having crossed the resin container 26, the softened fresh water of the water mains reaches the detergent dispensing assembly 9 and enters into the drawer flush circuit 19 directed towards the electrically-controlled hydraulic distributor 20. According to stage of the washing cycle, the hydraulic distributor 20 then channels said softened fresh water to one or more of the shower-making portions/sections 21*a* of the sprinkler head 21 (i.e. to one or more of the shower-making sections/portions of the upper lid or cover 22) for flushing the detergent, softener or other washing agent out of the corresponding detergent compartment 16*a* of the detergent drawer 16 and sweeping away said detergent, softener or other washing agent down into the washing tub via the drain duct 19.

When determined that the ion-exchange resins inside the resin container 26 are no more able to reduce the hardness degree of the fresh water directed to the washing tub 3 via the detergent dispensing assembly 9, the electronic central control unit (not shown) of laundry washing machine 1 performs, preferably immediately before the starting of the rinsing phase of the washing cycle, a regeneration process of the ion-exchange resins stored inside the resin container 26.

The regeneration process may also take place during the washing phase of the washing cycle, or can take place even when no washing cycle at all is running, preferably on specific request of the user.

During this regeneration process, the central control unit of laundry washing machine 1 firstly arranges the hydraulic distributor 20 so to channel the fresh water coming out of the water softening device 11 towards the water supply circuit 28, and then opens again the on-off valve 12 for enough time to form, on the bottom of drawer housing 32 (i.e. into the regeneration-agent reservoir 27), the whole amount of brine necessary for the resin regeneration process to take place. Before arriving into the salt drawer 31, the fresh water flows through the resin container 26, the rotatable water diverter 20*a* of hydraulic distributor 20 and finally the sprinkler head 33 on the upper lid or cover 22.

When the whole amount of brine is formed into the regeneration-agent reservoir 27, i.e. after having closed the on-off valve 12, the central control unit of laundry washing machine 1 activates the brine-circulating pump 29 to transfer/move the whole amount of brine at a time from the bottom of drawer housing 32, i.e. from the regeneration-agent reservoir 27, to the resin container 26, i.e. to the water-softening agent container 26.

Alternatively, at beginning of the regeneration process, the central control unit of laundry washing machine 1 firstly arranges the hydraulic distributor 20 so as to channel the fresh water towards the water supply circuit 28, and then opens for a short time the on-off valve 12 so to spill/pour a given amount of fresh water into the regeneration-agent reservoir 27 to form a small amount of brine.

When the small amount of brine is formed into the regeneration-agent reservoir 27, the central control unit of laundry washing machine 1 closes the on-off valve 12 and activates the brine-circulating pump 29 so as to start transferring/moving the brine (i.e. the salt water) from the bottom of drawer housing 32, i.e. from the regeneration-agent reservoir 27, to the resin container 26, i.e. to the water-softening agent container 26. Since the resin container 26 is completely filled with the fresh water of the water mains, the brine entering into the resin container 26 pushes out of the resin container 26 the fresh water previously stored therein. This fresh water, in turn, flow towards the hydraulic distributor 20 and then towards the water supply circuit 28 up to arrive into the regeneration-agent reservoir 27 where it forms other brine to be transferred into the resin container 26.

The central control unit of laundry washing machine 1 then maintains the brine-circulating pump 29 activated so as to continue circulating the fresh water in closed loop along the resin container 26 and the water supply circuit 28 for dissolving much more salt and increasing the salt degree of the brine into the resin container 26, until when the water-softening agent container 26 is completely filled with a sufficient amount of brine.

In both cases, when the water-softening agent container 26 is completely filled with a sufficient amount of brine, the central control unit of laundry washing machine 1 deactivates the brine-circulating pump 29 to watertight sealing the resin container 26 from the regeneration-agent reservoir 27, and to restrain the brine inside the resin container 26 for a predetermined time interval generally sufficient to allow the brine to remove from the ion-exchange resins the calcium and magnesium ions previously combined/fixed to said resins.

Preferably when the brine is restrained inside the resin container 26 for completing the regeneration process of the ion-exchange resins, the central control unit of laundry washing machine 1 also arranges the hydraulic distributor 20 so to put the outlet of the resin container 26 in direct communication with the auxiliary water drain line 35.

When the regeneration process of the ion-exchange resins is completed, the central control unit of laundry washing machine 1 opens again the on-off valve 12 of the fresh-water supply circuit 10, so that the pressurized fresh water of the water mains pushes the brine away from the resin container 26 and into the washing tub 3, or into the drain sump 36, or into the water filtering assembly 37, or into the water exhaust pump 39, via the water drain line 35. Alternatively, the central control unit of laundry washing machine 1 opens the on-off valve 43 to drain by gravity the brine out of the resin container 26 through the water drain line 41.

The brine stored in the resin container 26 therefore flows directly into the washing tub 3 or into the drain sump 36 or into the water filtering assembly 37, or into the water exhaust pump 39, via the water drain line 35 and/or via the water drain line 41.

Finally, preferably after having closed again the on-off valves 12 and 43, the central control unit of the laundry washing machine 1 activates the water exhaust pump 39 so to discharge the brine out of the laundry washing machine 1 preferably together with the washing or rinsing water already stored on the bottom of the washing tub 3, and continues the washing cycle.

The second fresh-water supply circuit 44, in turn, can channel the fresh water of the water mains towards the inlet of drawer flush circuit 18 bypassing the water softening device 11, so to channel the non-softened fresh water of the water mains directly towards the inlet of hydraulic distributor 20. Thus the electrically-controlled hydraulic distributor 20 can channel towards any one of the detergent compartments 16*a* of detergent drawer 16, or towards the first water drain line 35 if present, either softened or non-softened (i.e. normal) fresh water of the water mains.

The laundry washing machine 1 is therefore able to use, during each stage of the washing cycle, i.e. laundry wetting, pre-wash, main wash, rinsing, either softened or non-softened fresh water of the water mains or a mixture of them. The second fresh-water supply circuit 44, in fact, can channel non-softened fresh water to the inlet of the drawer flush circuit 18 of detergent dispensing assembly 9 independently from the fresh-water supply circuit 10, thus also at the same time of the fresh-water supply circuit 10.

In a less sophisticated embodiment, however, the electronic central control unit of the laundry washing machine 1 may be programmed to regenerate the ion-exchange resins stored in the resin container 26 after a given number of washing cycles. This number of washing cycles may be decided by the user on the basis of an alleged hardness degree of the fresh water coming out from the water mains.

In this less sophisticated embodiment the water-hardness sensor means monitor are unnecessary.

The advantages resulting from the presence of the second fresh-water supply circuit 44 are remarkable. The second fresh-water supply circuit 44, in fact, allows to significantly improve the working flexibility of the laundry washing machine 1. During the phases of the washing cycle where no detergent agents are required, such as, for example, the pre-wash and rinsing phases of the washing cycle, or even during the main washing phase, the laundry washing machine 1 can now use normal fresh water, thus significantly lengthening the time between the regenerations of the ion-exchange resins.

The brine-circulating pump 29, instead, allows to produce the brine (i.e. the salt water) using the fresh water currently stored inside the resin container 26, thus minimising the use of fresh water during the regeneration process. The brine-circulating pump 29 moreover allows to arrange the resin container 26, i.e. the water-softening agent container 26, spaced far away from the regeneration-agent reservoir 27, in any place inside the boxlike casing 2, thus even above the regeneration-agent reservoir 27.

Clearly, changes may be made to the front-loading laundry washing machine 1 as described above without, however, departing from the scope of the present invention.

For example, in an alternative non-shown embodiment the electrically-powered brine-circulating pump 29 may be replaced by an electrically-powered pump assembly comprising a conventional electrically-powered suction pump and an on-off valve which is arranged immediately upstream of the suction pump and is structured to watertight seal the suction/inlet of the electrically-powered suction pump when the latter is deactivated, and to put the suction/inlet of the electrically-powered suction pump in direct communication with the inside of the regeneration-agent reservoir 27 when the suction pump is activated.

Figure 7:
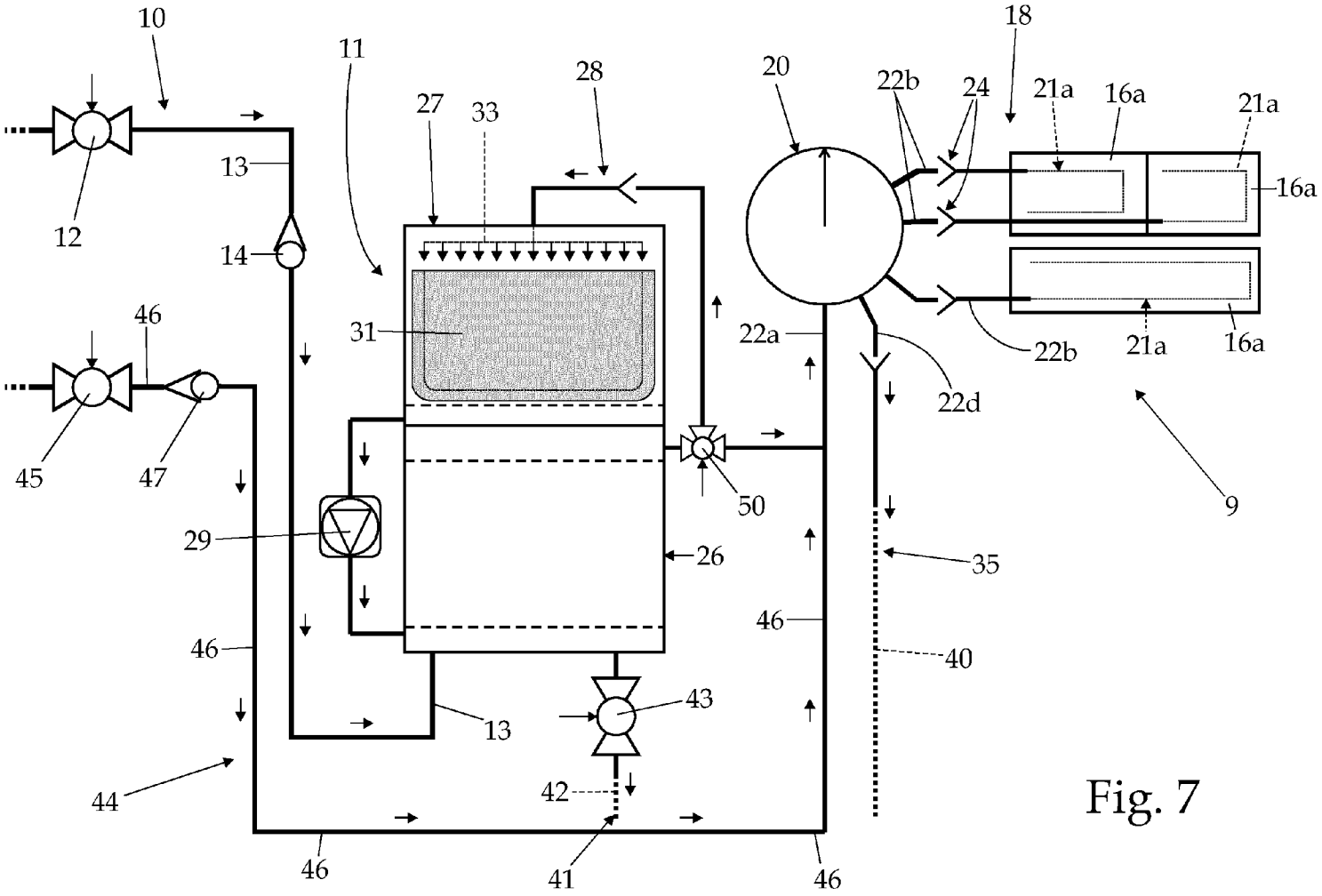
FIG. 7 is a schematic view of a first alternative embodiment of the internal detergent dispensing assembly and water softening device of the FIG. 1 laundry washing machine.

With reference to FIG. 7, in an alternative embodiment the water supply circuit 28 of water softening device 11 may comprise a three-way valve 50 arranged along the water line that channels the fresh water from the outlet of the resin container 26 to the inlet of the drawer flush circuit 18 of detergent dispensing assembly 9, and the sprinkler head 33 of the water supply circuit 28 is connected to said three-way valve 50. The three-way valve 50 is structured for selectively and alternatively-channeling the fresh water coming out of the resin container 26 either to the sprinkler head 33 for producing the brine or, according to the arrangement of the water softening device 11, to the inlet of the drawer flush circuit 18 of detergent dispensing assembly 9.

In this embodiment, therefore, the brine-circulating pump 29 circulates the fresh water in closed loop along the resin container 26 and the water supply circuit 28 without involving the hydraulic distributor 20. Thus the water supply circuit 28 of water softening device 11 is completely separated from the drawer flush circuit 18 of detergent dispensing assembly 9.

Figure 8:
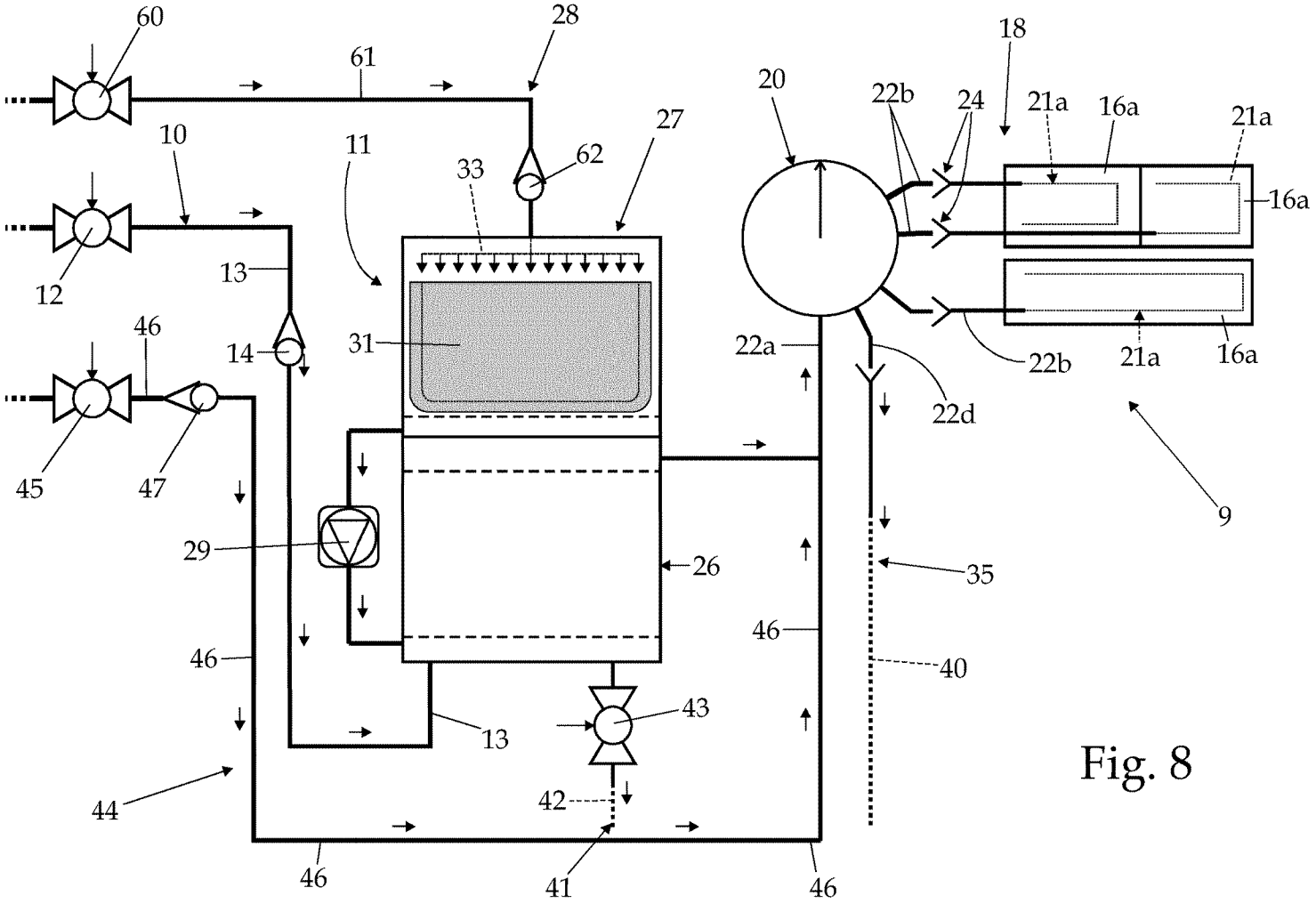
FIG. 8 is a schematic view of a second alternative embodiment of the internal detergent dispensing assembly and water softening device of the FIG. 1 laundry washing machine.

With reference to FIG. 8, in a second alternative embodiment the water supply circuit 28 of water softening device 11 may be structured for selectively draining fresh water directly from the water mains. In other words, the valve assembly of the water supply circuit 28 may comprise an electrically-controlled on-off valve 60 which is arranged/interposed between the water mains and the sprinkler head 33, and is able to control/regulate the flow of fresh water from the water mains towards the sprinkler head 33; and a hosepipe 61 or the like connecting the on-off valve 60 directly to the sprinkler head 33.

In this embodiment, the electrically-controlled on-off valve 60 is furthermore preferably dimensioned so as to have a nominal flow rate substantially equal to the nominal flow rate of the brine-circulating pump 29, so as to transfer/move the brine little by little from the regeneration-agent reservoir 27 to the resin container 26, thus minimising the permanency of the brine on the bottom of drawer housing 32.

Preferably, though not necessarily, the water supply circuit 28 of water softening device 11 may also have an additional one-way valve 62 which is located immediately downstream of the on-off valve 60, i.e. between the on-off valve 60 and the sprinkler head 33, and which is structured to allow the fresh water to only flow along hosepipe 61 from the water mains to the sprinkler head 33.

Also in this case, therefore, the water supply circuit 28 of water softening device 11 is completely separated from the drawer flush circuit 18 of detergent dispensing assembly 9.

Furthermore, in a first non-shown less sophisticated embodiment the brine-circulating pump 29 may be replaced by an electrically-controlled on-off valve which is structured to selectively and alternatively put the regeneration-agent reservoir 27 in direct communication with the water-softening agent container 26 for allowing the brine to flow by gravity from the regeneration-agent reservoir 27 to the water-softening agent container 26, or to completely water-tight seal/isolate the regeneration-agent reservoir 27 from the water-softening agent container 26. In this less sophisticated embodiment the water-softening agent container 26 has to be arranged beneath the regeneration-agent reservoir 27.

As an alternative, in a second non-shown less sophisticated embodiment the brine-circulating pump 29 may be replaced by a passive one-way valve which is structured for allowing the brine to flow by gravity from the regeneration-agent reservoir 27 to the water-softening agent container 26, and not vice versa.

The invention claimed is:

1. A laundry washing machine comprising:

an outer casing;

a washing tub inside the outer casing;

a rotatable drum arranged in an axially rotating manner inside the washing tub and structured for receiving the laundry to be washed;

a detergent dispensing assembly structured for supplying detergent into the washing tub;

a first fresh-water supply circuit structured for selectively channeling a flow of fresh water from water mains towards the detergent dispensing assembly and/or the washing tub; and a water softening device interposed between the first fresh-water supply circuit and the detergent dispensing assembly or interposed between the first fresh-water supply circuit and the washing tub, the water softening device being structured for reducing a hardness degree of fresh water supplied to the washing tub;

wherein the detergent dispensing assembly includes:

a detergent container provided with a plurality of detergent compartments each fillable with a respective detergent product;

a detergent flush circuit configured to receive the fresh water from the water softening device and structured for selectively spilling/pouring the fresh water arriving from the water softening device into any one of said plurality of detergent compartments; and a second fresh-water supply circuit connecting the water mains to the detergent flush circuit and bypassing the water softening device, the second fresh-water supply circuit being structured to:

control/regulate the flow of fresh water from the water mains towards the detergent flush circuit so as to selectively spill/pour non-softened fresh water into any one of the plurality of detergent compartments; and channel non-softened fresh water towards the washing tub, bypassing the plurality of detergent compartments and the water softening device, wherein the laundry washing machine includes an electrically-controlled hydraulic distributor or similar valve assembly arranged downstream of the water softening device, and structured for selectively and alternatively channeling softened fresh water arriving from the water softening device towards the plurality of detergent compartments of the detergent container; the second fresh-water supply circuit connecting the water mains to the electrically-controlled hydraulic distributor or similar valve assembly and bypassing the water softening device; and wherein the second fresh-water supply circuit includes a hosepipe connecting the water mains to the electrically-controlled hydraulic distributor or similar valve assembly and bypassing the water softening device.

2. The laundry washing machine according to claim 1, wherein the detergent flush circuit is structured for spilling/pouring a shower of water droplets by gravity into the plurality of detergent compartments of the detergent container.

3. The laundry washing machine according to claim 2, wherein the detergent flush circuit of the detergent dispensing assembly comprises a sprinkler head located above the detergent container and provided with a number of shower-making portions each of which is aligned to a corresponding detergent compartment of the detergent container and is structured for feeding a shower of water droplets by gravity only into the corresponding detergent compartment, and wherein the electrically-controlled hydraulic distributor or similar valve assembly is located upstream of the sprinkler head and is structured for channeling fresh water selectively and alternatively towards the number of shower-making portions of the sprinkler head.

4. The laundry washing machine according to claim 1, wherein the electrically-controlled hydraulic distributor or similar valve assembly is a rotatable hydraulic distributor.

5. The laundry washing machine according to claim 1, wherein the second fresh-water supply circuit comprises an electrically-controlled on-off valve fluidically interposed between the water mains and an inlet of the detergent flush circuit of the detergent dispensing assembly, and able to control/regulate the flow of fresh water from the water mains towards the inlet of the detergent flush circuit.

6. The laundry washing machine according to claim 1, wherein the water softening device comprises:

a water-softening agent container crossed by fresh water arriving from the first fresh-water supply circuit and is filled with a water softening agent able to reduce the hardness degree of fresh water flowing through the water-softening agent container;

a regeneration-agent reservoir structured to receive a salt or other regeneration agent for performing a regeneration of the water softening function of the water softening agent stored in the water-softening agent container; and a water supply circuit structured for selectively channeling a given amount of fresh water into the regeneration-agent reservoir to form brine, wherein the water-softening agent container is interposed between the first fresh-water supply circuit and the detergent flush circuit of the detergent dispensing assembly.

7. The laundry washing machine according to claim 6, wherein the water softening device further comprises an electrically-powered brine-circulating pump assembly interposed between the water-softening agent container and the regeneration-agent reservoir and structured for moving/transferring the brine from the regeneration-agent reservoir to the water-softening agent container when activated, and for watertight sealing/isolating the regeneration-agent reservoir from the water-softening agent container when deactivated.

8. The laundry washing machine according to claim 6, wherein the water softening device further comprises a valve assembly interposed between the water-softening agent container and the regeneration-agent reservoir and structured for selectively allowing the brine to flow by gravity from the regeneration-agent reservoir to the water-softening agent container.

9. The laundry washing machine according to claim 6, wherein the regeneration-agent reservoir comprises a regeneration-agent container which is fillable with a given quantity of regeneration agents, and wherein the water supply circuit of the water softening device is structured for selectively spilling/pouring a shower of water droplets by gravity into the regeneration-agent container.

10. The laundry washing machine according to claim 9, wherein the water supply circuit of the water softening device comprises:

a sprinkler head located above the regeneration-agent container and structured for feeding a shower of water droplets by gravity into said regeneration-agent container; and a valve assembly located upstream of said sprinkler head and structured for selectively channeling fresh water arriving from the first fresh-water supply circuit, or directly from the water mains, towards said sprinkler head.

11. The laundry washing machine according to claim 10, wherein the valve assembly of the water supply circuit of the water softening device is located downstream of the water-softening agent container so as to selectively channel towards the sprinkler head the fresh water coming out of the water-softening agent container.

12. The laundry washing machine according to claim 6, wherein the water supply circuit of the water softening device comprises a valve assembly, wherein the water supply circuit of the water softening device branches off from the electrically-controlled hydraulic distributor or similar valve assembly, and wherein the electrically-controlled hydraulic distributor or similar valve assembly incorporates the valve assembly of the water supply circuit of the water softening device.

13. The laundry washing machine according to claim 1, further comprising a first water drain line connected to the electrically-controlled hydraulic distributor and structured for channeling brine or fresh water arriving from the water softening device into the washing tub, or into a drain sump that extends downwards from a bottom of the washing tub, or into a water filtering assembly that is interposed between the drain sump of the washing tub and a suction of a water circulating pump and of a water exhaust pump of the laundry washing machine, or into the water exhaust pump.

14. The laundry washing machine according to claim 6, wherein the water softening device further comprises a second water drain line structured for selectively draining the brine or fresh water out of the water-softening agent container and channeling the brine or fresh water directly into the washing tub, or into a drain sump that extends downwards from a bottom of the washing tub, or into a water filtering assembly interposed between the drain sump of the washing tub and a suction of a water circulating pump and of a water exhaust pump of the laundry washing machine, or into the water exhaust pump.

15. The laundry washing machine according to claim 8, wherein the valve assembly comprises an electronically controlled on-off valve.

16. The laundry washing machine according to claim 8, wherein the valve assembly comprises a passive one-way valve.

17. The laundry washing machine according to claim 1, wherein the electrically-controlled hydraulic distributor or similar valve assembly comprises a plurality of electrically-controlled on-off valves interposed between the water softening device and the plurality of detergent compartments of the detergent container.

18. The laundry washing machine according to claim 1, wherein the electrically-controlled hydraulic distributor or similar valve assembly comprises a plurality of outlets, wherein the detergent flush circuit further comprises a plurality of air-break assemblies, each of the plurality of air-break assembly being located downstream of a corresponding outlet of the electrically-controlled hydraulic distributor or similar valve assembly and upstream of a corresponding detergent compartment of the detergent container.

* * * * *